US007053506B2

(12) United States Patent
Alonso et al.

(10) Patent No.: US 7,053,506 B2
(45) Date of Patent: May 30, 2006

(54) POWER CONVERTER CONTROL FOR AUTOMATIC MAXIMUM POWER POINT TRACKING

(75) Inventors: Corrine Alonso, Ramonville St. Agne (FR); Mohamed-Firas Shraif, Toulouse (FR); Augustin Martinez, St. Orens (FR)

(73) Assignee: Centre National de la Recherche Scientifique, Paris (FR)

( * ) Notice: Subject to any disclaimer, the term of this patent is extended or adjusted under 35 U.S.C. 154(b) by 287 days.

(21) Appl. No.: 10/466,303

(22) PCT Filed: Jan. 16, 2002

(86) PCT No.: PCT/FR02/00166

§ 371 (c)(1),
(2), (4) Date: Jan. 14, 2004

(87) PCT Pub. No.: WO02/056126

PCT Pub. Date: Jul. 18, 2002

(65) Prior Publication Data

US 2005/0099166 A1 May 12, 2005

(30) Foreign Application Priority Data

Jan. 16, 2001 (FR) ..... 01 00517

(51) Int. Cl.
*H01H 35/00* (2006.01)

(52) U.S. Cl. ..... 307/126; 250/203.4

(58) Field of Classification Search ..... 307/126; 136/246, 243, 244; 250/203.4; 324/609, 324/611; 126/601; 322/26; 323/906
See application file for complete search history.

(56) References Cited

U.S. PATENT DOCUMENTS

| | | | | |
|---|---|---|---|---|
| 3,566,143 | A * | 2/1971 | Paine et al. | 307/126 |
| 4,678,983 | A | 7/1987 | Rouzies | 323/222 |
| 5,923,100 | A | 7/1999 | Lukens et al. | 307/66 |
| 5,932,994 | A | 8/1999 | Jo et al. | 323/222 |
| 6,844,739 | B1 * | 1/2005 | Kasai et al. | 324/611 |

OTHER PUBLICATIONS

"A Novel Grid Interface for Photovoltaic, Wind-Electric, and Fuel Cell Systems with a Controllable Power Factor of Operation"; R. Naik et al., Proceedings of the Annual Applied Power Electronics Conference and Exposition (APEX), Dallas, Mar. 5, 1995, New York, IEEE, vol. 2, Conf. 10, pp. 995-998; XP000528123; ISBN: 0-7803-2483-8.

"Integrated Photovoltaic Maximum Power Point Tracking Converter", Johan H.R. Enslin et al., IEEE Transactions on Industrial Electronics, IEEE Inc., New York, vol. 44, No. 6, Dec. 12, 1997, pp. 769-773; CP000750720; ISSN: 0278-0046.

* cited by examiner

*Primary Examiner*—Shawn Riley
(74) *Attorney, Agent, or Firm*—Duane Morris LLP

(57) ABSTRACT

The invention concerns a method and a circuit for maximum power point tracking of a variable power source from a comparison of an image of the power (P) supplied by the power source, the circuit comprising two elements (14, 31) providing different propagating delays to a physical quantity proportional to the power image, a comparator (16) of the outputs of the delaying elements to control a trigger (17) supplying a signal (Q) with two automatic control states to a static power converter, and means (33) for detecting a transitory operating condition from variations in oscillations of an established operating condition and means (32) for modifying the delay input by the slower delaying element (31).

10 Claims, 3 Drawing Sheets

POWER CONVERTER CONTROL FOR AUTOMATIC MAXIMUM POWER POINT TRACKING

PRIORITY FILING

This application claims priority of the earlier filing date, under 35 U.S.C. 119, of the commonly owned PCT-based patent application, filing number PCT/FR02/00166, filed on Jan. 16, 2002, which claims priority of French Application No. 10/00517 filed on Jan. 16, 2001.

BACKGROUND OF THE INVENTION

1. Field of the Invention

The present invention relates to the field of power converters and, more specifically, power converters equipped with a maximum power point tracking control circuit. Such converters are generally applied to the conversion of power provided by an irregular source. In the context of the present invention, "irregular" power source means a power source providing a power likely to undergo abrupt variations, as opposed to power sources providing a stable or slowly-varying power, as is the case for a battery or for the A.C. supply network. Such sources are, for example, photovoltaic panels providing a power varying according to the lighting, wind engines providing a power varying according to the wind speed, elements of tidal power exploitation providing a power varying according to the wave intensity, etc.

The present invention will be described hereafter in relation with photovoltaic element panels. However, the present invention more generally applies to different power sources for which an automated tracking of the maximum power point is needed to optimize the output in case of a power generation.

2. Discussion of the Related Art

A power converter of the type to which the present invention applies is of static converter type, with its component operating in switched mode (on/off). The input and output voltages may indifferently be D.C., A.C. voltages, or others (for example, pulse voltages). The converter can then be a D.C./D.C., D.C./A.C., A.C./D.C. converter, etc. A currently-used control technique for the switching of the converter semiconductor component(s) is the control by pulse width modulation (PWM) at the turning-off and at the turning on of a power transistor. The width of the pulses for controlling the turning-on of the power transistor is regulated according to the load and to the power required by said load. In the applications of the present invention, the pulse width is further regulated according to the power provided by the power source by tracking, for yield reasons, the maximum power point.

FIG. 1 very schematically shows in the form of blocks a conventional example of a power converter of the type to which the present invention applies. In this example, the converter is a voltage step-up D.C./D.C. converter.

Assume a power source 1 formed of photovoltaic elements PV providing a voltage V which is applied across an inductive element L in series with a PWM controlled power switch 2. In the example shown, power switch 2 is formed of a MOS transistor having a gate receiving a signal CTRL formed of a train of pulses of variable width according to the control orders. The junction 3 of inductive element L and switch 2 is connected to the anode of a free wheel diode D having a cathode connected to a first (positive) electrode 4 of a storage capacitor C. Capacitor C provides, between its electrodes 4 and 5, a regulated voltage Vout or current Iout of D.C., A.C. or other type according to the nature of the load connected between electrodes 4 and 5. Electrode 5 of capacitor C corresponds to a reference voltage, for example the ground, for voltage V of panel 1, for power switch 2, and for the output voltage.

When switch 2 is on (for a MOS transistor, this corresponds to an operation in ohmic mode), diode D is reverse biased. Capacitor C supplies the load connected across terminals 4 and 5. Power is accumulated in inductive element L across which is applied voltage V provided by the photovoltaic panel 1. When transistor 2 is off, the power stored in inductance L is transferred to capacitor C by diode D. The operation of a pulse-width modulated power converter is well known and will not be detailed any further. Various types of power switch assemblies are known, according to whether the converter is a step-down, step-up, or step-up/step-down converter.

When the voltage source providing voltage V is irregular, a maximum power point tracking control circuit (MPPT) 10 is generally used. Such a circuit has the function of modifying the width of the pulses for turning on switch 2 according to the variations of the power provided by power source 1. At its input, circuit 10 thus receives a signal (for example, a voltage) proportional to power P provided by source 1. In the example of FIG. 1, power P is obtained by means of a multiplier 7 of a current measurement I in the photovoltaic elements by a measurement of voltage V across panel 1. Circuit 10 provides a two-state signal Q intended to increase, respectively, decrease, the width of the control pulses of switch 2.

Signal CTRL of control of switch 2 is provided by a comparator 11 (COMP) of the converter controlled by circuit 10. This comparator receives, on a first input, a periodic signal provided by a generator 12, for example, a sawtooth of constant high frequency. A second input of comparator 11 receives the output of a ramp generator 13 (RAMP) having its direction inversion (ascending ramp, descending ramp) conditioned by the state of signal Q. The frequency of the sawtooth conditions the frequency, generally constant, of the pulse train of signal CTRL. The instantaneous level provided by generator 13, formed for example of an RC circuit, sets the comparison reference, and thus the pulse duty cycle.

To generate signal Q, circuit 10 comprises two resistive and capacitive circuits 14, 15 (RCF and RCS) forming delay lines of power signal P with different time constants. Circuit 14 is, for example, a high speed circuit as compared to circuit 15, which has a longer time constant. The respective outputs of circuits 14 and 15 are connected to the inputs of a comparator 16 (COMP), the output of which controls a flip-flop 17 (T) providing signal Q. Hereafter, Q will indifferently be used to designate the forward (non inverted) output terminal of flip-flop 17 or the signal present on this terminal. Flip-flop 17 is a flip-flop with no clock signal. It is, for example, a JK-type flip-flop assembled as a so-called T-type flip-flop.

The structure and operation of a circuit such as shown in FIG. 1 is perfectly well known. An example of such a circuit is described in article "Step-Up Maximum Power Point Tracker for Photovoltaic Arrays" by Ziyad Salameh, published in the proceedings of the American Solar Energy Society Conference of Jun. 20 to 24, 1988, pages 409–414. Its operation will briefly be reminded hereafter.

The examination of the slow and fast variations of power P provides an image of the derivative of this power. Due to the time constant difference of RC circuits 14 and 15, the output of comparator 16 oscillates. The frequency and amplitude of these oscillations depend on the time constants of the RC circuits. In fact, comparator 16 indicates, according to its output state (high or low) the sign of the derivative of the power. As long as the output of comparator 16 remains in a same state, the output of flip-flop 17 does not switch state. Assuming a state 1 at the input and at the output of flip-flop 17, the resistive and capacitive circuit of ramp generator 13 builds up power. This increases the corresponding input level of comparator 11 and increases the duty cycle of signal CTRL. Assuming that the load receiving voltage Vout is constant, power P will increase to a maximum, then start decreasing along with the increase in voltage V. When the power starts decreasing, the output of comparator 16 switches, which causes a switching of output signal Q of flip-flop 17. Said signal then switches low, which causes the discharge of the RC circuit of ramp generator 13 and a decrease in the duty cycle. The output voltage then starts increasing again. At constant load, the circuit converges towards a maximum power point and oscillates around this point.

This operation is illustrated in FIG. 2, which shows two examples of the course of power P according to voltage V for two lighting quantities received by panel 1. A first curve 21 illustrates, for example, the case of a maximum lighting. As just described, at constant load, the system will oscillate around maximum power point PMM1.

If the lighting of panel 1 changes (for example, by the coming of shadow), characteristic P=f(V) of panel 1 becomes a curve 22 of lower level. This curve also exhibits a maximum power point PMM2. However, the control system shown in FIG. 1 cannot make out a lighting change from an abrupt variation of the load connected at the converter output or from a mere variation around the maximum power point of curve P=f(V) on which stands its operating point. The control system is then lost and may even find itself in a steady state no longer corresponding to the maximum power point. In fact, the circuit diverges towards a minimum load or maximum load state according to the flip-flop state preceding the change of curve P=f (V). The same problem is posed in the case of an abrupt variation in the supplied load.

A first solution consists of choosing very different time constants of delay elements 14 and 15. However, this adversely affects the output because of the significant generated oscillations.

Another known solution consists of forcing the system to start back from the origin of curves P=f (V). It is then started from a very small duty cycle, which is increased to converge back towards the maximum power point of the current lighting curve. A disadvantage of such a solution is that it considerably slows down the control by the lighting of the photovoltaic panel or by the abrupt variations of any power source connected upstream of the system. Further, the differentiation between a maximum power point change (curve change) and a normal variation also poses a problem in terms of detection duration and reliability.

FIG. 3 illustrates an example of characteristic of current I provided by the photovoltaic panel along time at a power curve change of the panel. It is assumed to initially be (times t0 to t1) on a maximum lighting curve (21, FIG. 2). Current I then slightly oscillates around a value Imax, assuming a constant load. A lighting change at time t1 causes a reference loss for the control system. In the example shown in FIG. 3, it is assumed that the system is then restarted at a time t2 subsequent to time t1 after having discovered the system reference loss. It is then converged until a time t3 towards a new maximum power point corresponding to a current Iomb around which the system then starts slightly oscillating.

The amplitude of the oscillations around values Imax and Iomb of course depends on the time constants of RC circuits 14 and 15. The greater the difference between time constants, the larger the amplitude of the oscillations at the output of comparator 16. The faster it is converged towards the maximum power point (duration between times t2 and t3), the greater the oscillation amplitude. However, the greater the oscillations, the more adversely this affects the system output. A compromise must thus be made between output, speed, and stability.

Problems of system convergence after maximum power point changes are posed especially in case of a variable power source. However, even if the input power source is stable a priori as should be the case, for example, for photovoltaic panels used in space (without clouds), such convergence problems may be encountered. Indeed, space infrastructures having more and more complex geometries, shadow areas due to the very structure of satellites may appear. Further, sensors may be partially damaged by dust impact, which leads to the same result.

Another known solution to overcome the disadvantages linked to abrupt variations of the power source is to use a digital circuit. The different operating points are successively memorized to recognize a drift. A digital system however remains slow to isolate a drift from a normal operating variation. On this regard, the larger the amplitude of the accepted oscillations in steady state, the slower the system will be in recognizing a state change due to a change in the power source. Another disadvantage of a digital circuit is that it is in practice limited to frequencies of pulse trains for controlling switch 2 of some hundred kHz. On this regard, an analog control circuit such as that illustrated in FIG. 1 has the advantage of being able to operate at higher cut-off frequencies (on the order of one MHz). This eases the converter integration.

SUMMARY OF THE INVENTION

The present invention aims at overcoming the disadvantages of known circuits for tracking the maximum power point of a static converter of switched-mode power supply type.

The present invention more specifically aims at optimizing the converter output without adversely affecting its response speed.

The present invention also aims at enabling the control circuit to converge back towards a new maximum power point in case of a variation in the power source, due to a simple circuit of analog type.

The present invention also aims at preserving the control performed by the circuit in case of a variation in the load connected at its output.

The present invention further aims at providing an integrable solution compatible with a high-frequency operation of the switched-mode power supply.

To achieve these objects, the present invention provides a circuit for tracking the maximum power point of a variable power source based on a comparison of an image of the power provided by the power source, the circuit comprising:

two elements introducing different propagation delays in a quantity proportional to the power image;

a comparator of the outputs of the delay elements to control a flip-flop providing a two-state signal for controlling a static power converter;

means for detecting a transient state from variations of oscillations of a steady state; and means for modifying the delay introduced by the slowest delay element.

According to an embodiment of the present invention, said means for modifying the delay are formed of a switching element capable of, in transient state, inhibiting the operation of the slower delay element.

According to an embodiment of the present invention, said detection means compare the duration of an active state on each output signal of the flip-flop with a predetermined threshold.

According to an embodiment of the present invention, the detection means compare, independently from each other, the forward and reverse outputs of the flip-flop and combine the result of these comparisons to provide a control pulse to the means for making the delay variable.

According to an embodiment of the present invention, the duration of the transient state is selected according to the desired oscillation amplitude around a nominal power reference value.

According to an embodiment of the present invention, the different voltage, current, and time measurement elements are analog.

According to an embodiment of the present invention, the circuit comprises means for resetting the flip-flop upon occurrence of a transient state.

According to an embodiment of the present invention, the circuit comprises means for, upon occurrence of a transient state, resetting a ramp generator conditioning the duty cycle of a pulse-width modulation control signal of the power converter.

The present invention also provides a method for controlling a circuit for tracking the maximum power point of a variable power source of the type applying two delays of different value to an image of the power provided by the power source, which consists of inhibiting or shortening the shortest delay during a transient state.

According to an embodiment of the present invention, the existence of a transient state is determined from a measurement of the frequency of oscillations around a nominal operating point of the maximum power point detector.

The foregoing objects, features, and advantages of the present invention will be discussed in detail in the following non-limiting description of specific embodiments in connection with the accompanying drawings.

DETAILED DESCRIPTION

Figure 1:
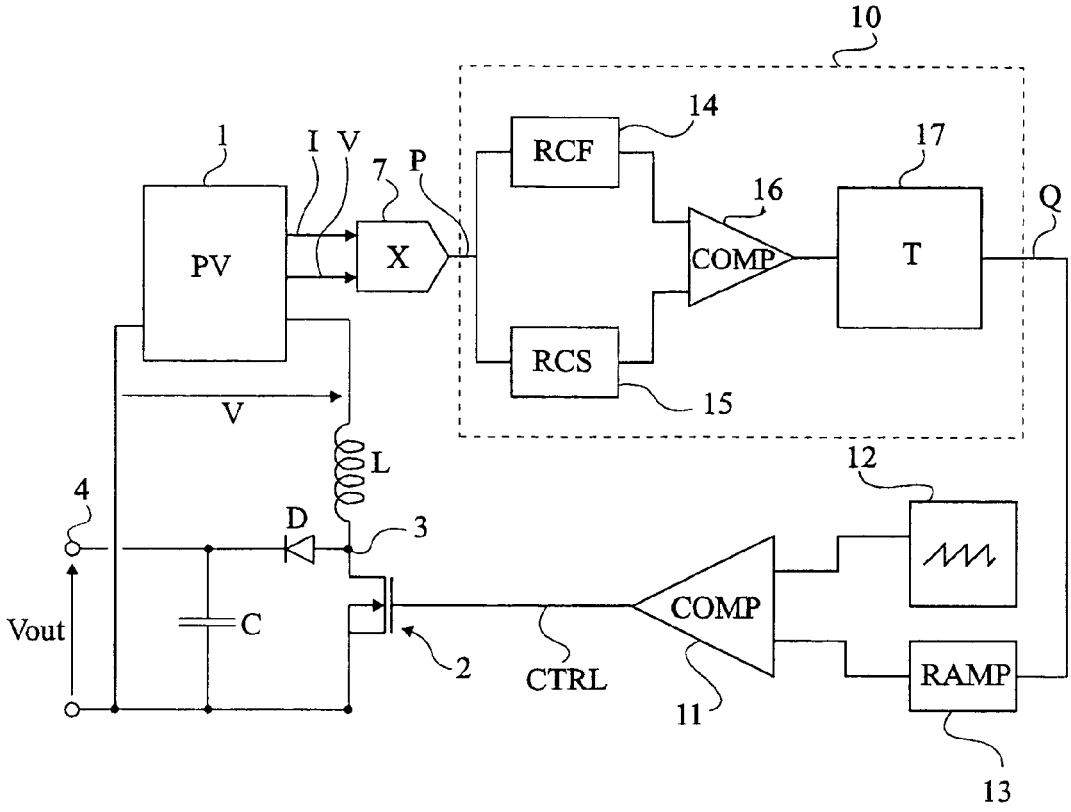
FIG. 1, previously described, shows a conventional example of a power converter of the type to which the present invention applies.
Figure 2:
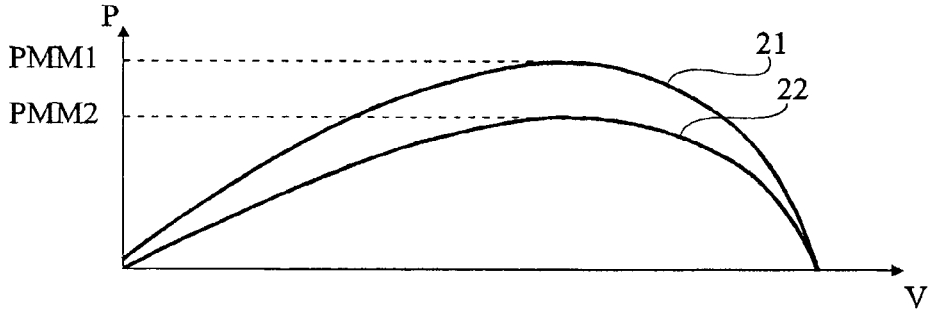
FIG. 2 shows two examples of the course of the power according to the voltage in a photovoltaic panel forming a power source of a converter according to the present invention.

Same elements have been designated with same reference numerals in the different drawings. For clarity, only those elements which are necessary to the understanding of the present invention have been shown in the drawings and will be described hereafter. In particular, the forming of a power source exploited by a converter of the present invention has not been detailed and is no object of the present invention.

A feature of the present invention is to make one of the two delay elements exploiting the power information provided by the power source controllable. Advantage is then fully taken of the different functions of the respective time constants of the delay elements. Indeed, the slower delay element brings stability to the system while the faster delay element accelerates the convergence towards the maximum power point in case of a drift. Accordingly, by making the slower delay element faster or, preferably, by inhibiting it during a transient state corresponding to starting or disturbance periods linked to a state change, the system convergence towards the maximum power point is accelerated. According to the present invention, when this point is reached, the slower delay element is put back into service or its time constant is lengthened. Thus, steady-state oscillations are minimized.

The minimum duration of a transient state according to the present invention depends on the transient state of the converter and on the power source. More precisely, the duration range for a transient state depends on the converter, on the charge curve of its input impedance, as well as on the permitted charge excess, that is, the oscillation amplitude which is allowed in steady state, etc. In the application to photovoltaic panels, the transient state duration provided by the present invention essentially depends on the time constant set by the equivalent resistance of the panel and by an input capacitance of the converter. This input capacitance is generally provided across the panel to prevent propagation of the switch's switching noises.

As a specific example of embodiment in a system where the slower delay element has a time constant on the order of one ms while the faster has a time constant on the order of some ten μs, it is provided to transiently pass onto a time constant on the order of 10 μs for a convergence phase lasting for from 10 to 50 ms.

Another feature of the present invention is to provide a detection of transient states, that is, of the need for switching to an operation with an accelerated time constant, from the steady state oscillation frequency. Indeed, a state switching of the system, for example, a change in the maximum power point of the power source, translates as a change in the steady-state oscillation frequency, or even as a disappearing of the oscillations. Thus, according to the present invention, an oscillation frequency range corresponding to a steady state is defined, and a switching of the system to a transient operating mode is caused when it is detected that it is moving away from this frequency range. The minimum and maximum oscillation frequencies are determined based on the oscillation rates that one is ready to accept for the system.

In practice, a maximum oscillation rate corresponds to a minimum frequency of these oscillations and corresponds to the state of maximum power provided by the power source. Conversely, a minimum oscillation rate corresponds to a maximum frequency and to a state of minimum power of the power source (for example, an operation in the shade of a photovoltaic panel).

Preferably, for stability reasons, the time constant of the ramp generator controlled by the maximum power point tracking circuit is greater than the maximum system input time constant. This maximum time constant corresponds, for a photovoltaic panel, to the time constant under minimum lighting.

Figure 4:
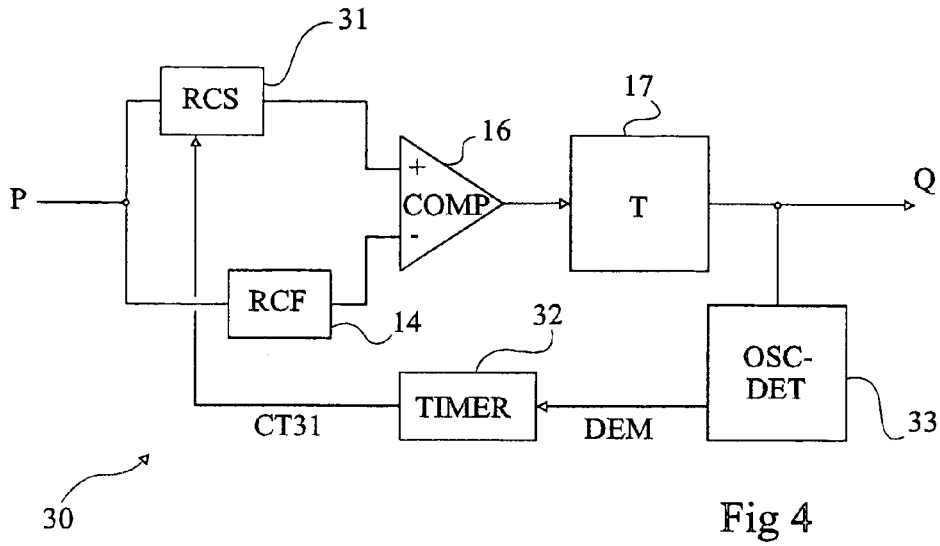
FIG. 4 very schematically shows in the form of blocks an embodiment of a maximum power point tracking circuit according to the present invention.

FIG. 4 shows, in a very simplified view in the form of blocks, an embodiment of a maximum power point tracking circuit according to the present invention. In FIG. 4, only circuit 30 receiving power information P and providing a signal Q for controlling a ramp generator of the type illustrated in FIG. 1 has been shown. The other elements of the power converter and of the power source, be they means for obtaining the power information or for exploiting control signal Q, are conventional, and a circuit such as illustrated in FIG. 1 may for example be used.

As previously, control circuit 30 uses a comparator 16 (COMP) for controlling a flip-flop 17 (T) having its forward output Q providing the control signal of the ramp generator (13, FIG. 1). Conventionally still, the two inputs of comparator 16 receive a signal representative of the power information provided by the power source with a time shift provided by two respective delay elements 14 and 31. Delay element 14 is, as previously, relatively fast (RCF). According to the present invention, delay element 31 has a relatively slow nominal state (RCS) and is controllable, either for a decrease in its time constant during a transient state, or to be inhibited during this transient state. A signal CT31 for controlling delay element 31 is a pulse signal exhibiting a pulse of inhibition or acceleration each time a transient state is detected. Signal CT31 is, for example, provided by a circuit 32 (TIMER) functionally forming a generator of isolated pulses, of predetermined durations. Circuit 32 is controlled by a signal DEM causing the occurrence of a pulse. Signal DEM is provided by a circuit 33 (OSC-DET) for detecting an oscillation variation in output signal Q provided by flip-flop 17. Circuit 33 samples the signal at the output of flip-flop 17 to detect a variation in the oscillation frequency such that this frequency moves away from a range of predetermined nominal operation values.

As an alternative, the oscillation detector of the present invention may sample a signal at any other location of control circuit 30 exhibiting steady-state oscillations, that is, where the signal shape reflects the steady-state regulation. For example, the output signal of comparator 16 may be sampled.

According to another alternative embodiment, the detection of an instability loss may be obtained from images of the current, of the voltage, or of the power provided by the power source, all these signals having the same frequency. A frequency loss or variation with respect to a predetermined range of the state-state oscillation frequency is however still detected according to the present invention. Reference is made to an instability loss since the disappearing of oscillations translating as an undesired stability of the power converter is detected.

Figure 5:
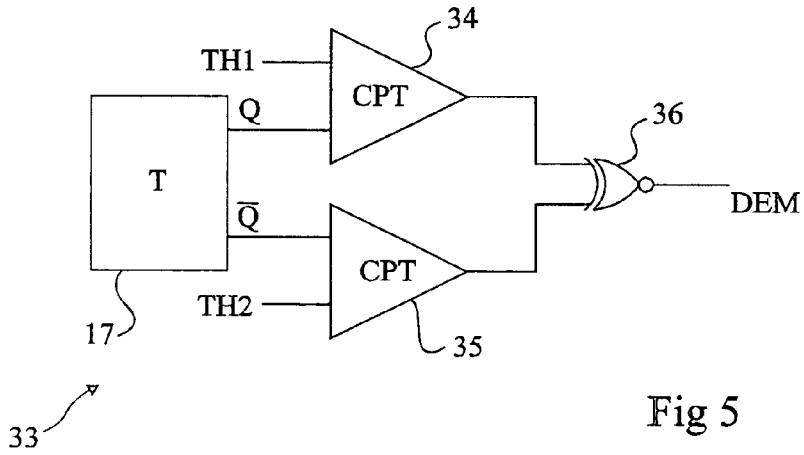
FIG. 5 shows a functional block diagram of a transient state detector of the circuit of FIG. 4.

FIG. 5 schematically shows in the form of blocks an embodiment of an instability detection circuit 33 according to the present invention. According to this embodiment, circuit 33 exploits the two forward and reverse outputs Q and $\overline{Q}$ of flip-flop 17 to detect a variation in both directions of the system stability. Outputs Q and $\overline{Q}$ are respectively connected to the inputs of two time comparators 34 and 35 (CPT) having their second respective inputs receiving time thresholds TH1 and TH2. In other words, each comparator 34 or 35 compares the duration for which signal Q and $\overline{Q}$ associated therewith remains in a stable active state with respect to a predetermined duration. As soon as this duration is exceeded, the comparator output switches to trigger a transient state pulse due to signal DEM. The respective outputs of comparators 34 and 35 are combined by an XNOR gate 36 having the function of suppressing states which are non-significant for the detection.

Thresholds TH1 and TH2 are chosen according to the largest oscillation period of the system in steady state. This period is a function, among others, of the maximum and minimum lightings that the panel can receive, of the converter, and of the load for which the system is provided, and depends on the stability which is desired to be given to the system. For example, thresholds TH1 and TH2 are set so that they generate a pulse when, for a given time ranging between 2 and 5 times the maximum oscillation period, there has been no oscillation, that is, no state switching of outputs Q and $\overline{Q}$.

Figure 3:
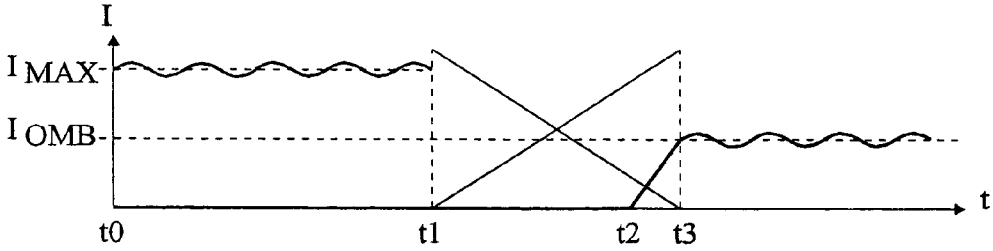
FIG. 3 shows the current variation along time in case of a change of lighting of a photovoltaic panel of the converter of FIG. 1.

The two time comparators 34 and 35 enable detecting a stable state of the oscillation of the signal provided by the power source (for example, the current of FIG. 3), whether this stable state is at the low or at the high allowed oscillation level. The discussion of FIG. 5 corresponds to a functional description of the instability detector of the present invention. In practice, it will be ascertained that the output of comparators 34 and 35 remains stable for a duration corresponding, preferably, to from two to five times the largest oscillation period that the control can generate, according to the desired sensitivity to variations. An untimely starting of the system is thus avoided when in steady state.

An advantage of the present invention is that it enables detection of a loss of the maximum power point steady state on which is set the system without knowing the origin of this loss. In particular, it is not necessary to provide other sensors than sensors currently used for the maximum power point determination.

Another advantage of the present invention is that it enables fast new convergence of the system in case of a maximum power point change.

Another advantage of the present invention is that it forms a particularly reliable system due to the means used.

Figure 6:
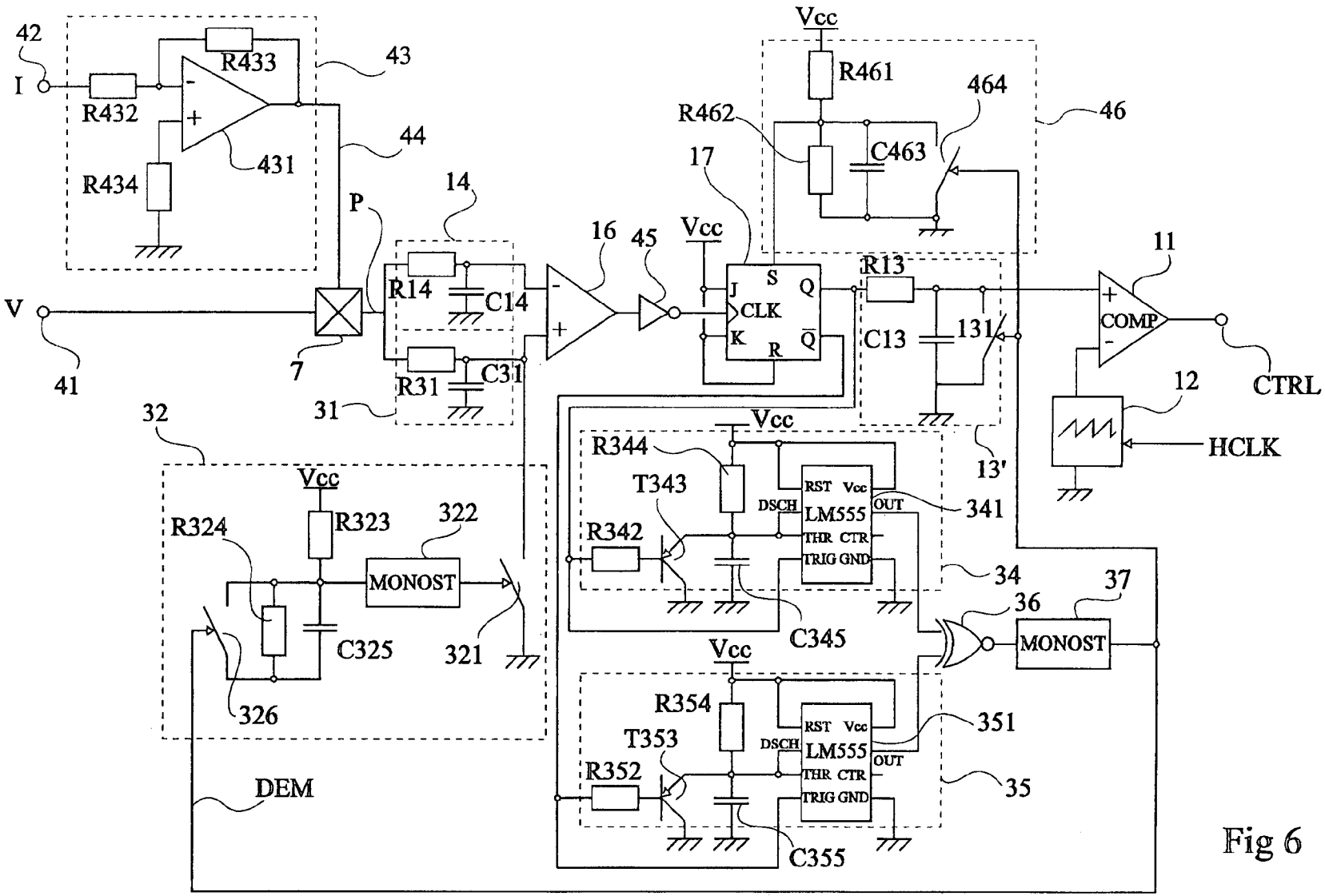
FIG. 6 is a more detailed electric diagram of a control circuit according to the present invention.

FIG. 6 shows a more detailed embodiment of a circuit 30 according to present invention. The example of FIG. 6 aims at illustrating, in particular, the integrable character of the present invention.

In the representation of FIG. 6, a conventional example of exploitation of signals I and V (FIG. 1) of the power source has further been illustrated. A measurement of voltage V, applied on a terminal 41 of circuit 30, is applied on a first input of multiplier 7, the output of which provides power signal P exploited by the control circuit. As for the detection of current I, its measurement is applied on a terminal 42 and crosses a scaling circuit 43 before reaching the second input of multiplier 7. The optional use of a scaling circuit 43 depends on the amplitude of the measured variations at the power source level. The scaling factor circuit is conventional. It is, for example, formed of an operational amplifier 431 having its inverting input connected, by a resistor R432, to terminal 42 and, by a resistor R433, to an output terminal 44 corresponding to the second input of multiplier 7. The non-inverting input of amplifier 431 is connected to ground by a resistor R434. The sizing of the resistors of a scale factor conversion circuit is within the abilities of those skilled in the art and is no object of the present invention.

The output of multiplier 7 providing signal P is connected to the respective inputs of the two delay elements 14 and 31. In the example shown, these delay elements have the simplest possible form, that is, that of a resistive and capacitive circuit. Thus, the output of multiplier 7 is connected to a first input of a resistor R14 of element 14, a second input of which is connected to the inverting input of comparator 16 and, by a capacitor C14, to ground. The output of multiplier 7 is also connected to a first terminal of a resistor R31 of delay element 31, the second terminal of resistor R31 being connected to the positive input of comparator 16 and, by a capacitor C31, to ground. The components of RC circuits 14 and 31 are of course different to introduce the time constant difference necessary to the operation of the present invention. For example, resistors of same value may be used, the time constants of the two delay elements being differentiated by means of capacitors C14 and C31 of different values. The output of comparator 16 crosses an inverter 45 having its output connected, in the example shown, to clock input CLK of flip-flop 17 formed from a JK flip-flop. Inputs J and K of the flip-flop are connected to a terminal of application of the positive supply voltage Vcc, as well as flip-flop reset terminal R. The forward output Q of the flip-flop is connected to the input of a ramp generator 13' intended to set the duty cycle of the pulses for switching the power supply (signal CTRL). The output of generator 13' is connected to a first input of comparator 11, the second input of which receives a periodic signal provided by generator 12. This signal, for example, a sawtooth signal preferably is a signal of high frequency set by a clock HCLK. All that has first been described approximately corresponds to a conventional circuit.

According to the present invention, the non-inverting input of comparator 16, that is, the output of delay element 31, is grounded by a switch 321 of circuit 32. Functionally, this corresponds to control signal CT31 discussed in relation with FIG. 4. When switch 321 is off, a normal operation corresponding to a steady state and to that of a conventional circuit is reproduced. When switch 321 is on, the corresponding input of comparator 16 is, according to the present invention, grounded, which inhibits the operation of slow delay element 31.

Circuit 32 providing a delayed control pulse to element 31 comprises, for example, a timing circuit 322, for example a monostable circuit (MONOST), the output of which controls switch 321 (for example, a MOS transistor). The control input of circuit 322 is connected to the midpoint of a series association of two resistors R323 and R324 across which is applied supply voltage Vcc. The control input of circuit 322 is further grounded by means of a capacitor C325. Circuit 322 aims at shaping a control pulse having its duration set by the resistive and capacitive elements placed at its input. In particular, the values of resistors R323 and R324 condition the charge time of capacitor C325 and, accordingly, the pulse duration. The input of circuit 322 is, preferably, grounded by means of a switch 326 controlled by signal DEM detecting a transient state.

In steady state, switch 326 is off, the input of circuit 322 thus is high (substantially at voltage Vcc, neglecting the voltage drop in resistor 323 of relatively small value). Switch 321 is accordingly off. When signal DEM causes the turning-on of switch 326, this discharges capacitor 325 and switches the input of circuit 322 low. This thus causes a switching of the output of monostable circuit 322, which turns on switch 321. Since signal DEM is of pulse form, the ground connection of the input of circuit 322 rapidly disappears by the turning-off of switch 326. Capacitor C325 can then again be charged by resistive dividing bridge R323–R324, which conditions the pulse duration. As soon as the threshold of circuit 322 is reached, its output switches back and switch 321 turns off to place the system back in steady state.

According to a preferred embodiment of the present invention, signal DEM is also used to reset ramp generator 13' formed, in this example, of an RC cell (resistor R13 and capacitor C13). A first terminal of resistor R13 is connected to terminal Q of flip-flop 17. The other terminal of resistor R13 is connected to a first input of comparator 11 and, by capacitor C13, to ground. According to the preferred embodiment of the present invention, a switch 131 short-circuits capacitor C13 to force its discharge when signal DEM is active. A restarting of the ramp conditioning the duty cycle at a value always identical at each transient period is thus generated. The example shown considers a restarting from zero. As an alternative, a predetermined precharge level may be provided for this restarting.

Preferably, for stability reasons, the slow time constant, here, R31*C31, is chosen to range between 1/20 and 1/2 of the time constant of ramp generator 13', here, R13*C13. As for fast element 14, its time constant, here, R14*C14, is chosen according to the dynamic range desired for the system. For example, a constant R14*C14 ranging between 1/10 and 1/2 of the slow time constant (R31*C31) may be provided.

Still according to this preferred embodiment, signal DEM is also used according to the present invention to reset flip-flop 17. For this purpose, input S of flip-flop 17 is connected to a circuit 46 applying a calibrated reset pulse. Circuit 46 is, for example, formed of a resistive dividing bridge R461, R462, supplied by voltage Vcc and used to charge a capacitor C463 connected between the midpoint and the ground. Terminal S of flip-flop 17 is connected to this midpoint. A switch 464 controllable by signal DEM is used to force the discharge of capacitor C463. In steady state, switch 464 is off, capacitor C463 is charged, and input S of flip-flop 17 is high. A turning-on of switch 464 by signal DEM after a detection of a transient state causes the discharge of capacitor C463 and the switching of input S to zero, and thus the resetting of flip-flop 17. As soon as signal DEM disappears, switch 464 turns off, which enables progressive charge of capacitor C463 by dividing bridge R461, R462. The function of circuit 46 is to provide a pulse of sufficient duration for the reset of flip-flop 17. By resetting flip-flop 17 at each transient state, the system reliability is optimized by setting the initial state of any transient state (starting or lighting change).

Outputs Q and $\overline{Q}$ of flip-flop 17 are also sent as an input to both instability loss detection circuits 34 and 35 according to the present invention. Each circuit 34, 35 is, in the example shown, based on a timing circuit, respectively, 341, 351, of a type known under trade name LM555, assembled as a monostable circuit. Each circuit 341 or 351 has its output connected to one of the inputs of XNOR-type gate 36. In the example shown, the output of gate 36 crosses a monostable circuit 37 to shape pulse DEM. This circuit is optional. Circuits 341 and 351 have their supply terminals Vcc and GND respectively connected to the terminals of application of the circuit supply voltage. Control voltage terminals CTR of circuits LM555 are left in the air. Their reset terminals RST are brought to voltage Vcc. Their respective triggering terminals TRIG are connected to outputs Q and $\overline{Q}$ of flip-flop 17. Outputs Q and $\overline{Q}$ are also respectively connected to first terminals of resistors R342 and R352 having their second respective terminal connected to the base of PNP-type transistors T343 and T353. The collectors of transistors T343 and T353 are grounded. Their respective emitters are connected to the threshold (THR) and discharge (DSCH) terminals of the corresponding circuits 341 and 351. Further, each terminal THR is connected to the junction point of a resistor R344, respectively, R354, with a capacitor C345, respectively C355.

Functionally, the disappearing or the decrease of the low-state oscillations may be related to the case where the system stabilizes in open circuit. Conversely, the disappearing of the oscillations in the high state may be related to the case of a short-circuited system. Stage 34 corresponds to the open circuit detection while stage 35 corresponds to the short-circuit detection.

Thresholds THR of timing circuits LM555 correspond to a high state (voltage Vcc minus the voltage drop in resistors R344 and 354, respectively) when the corresponding transistor T343 or T353 is off. In other words, when terminal Q, respectively, $\overline{Q}$, is low, transistor T343, respectively T353, is on, the corresponding capacitor C345 or C355 is short-circuited and threshold input THR of the corresponding circuit LM555 is low. Since, meanwhile, triggering input TRIG of the circuit is also low, its output OUT remains low.

When one of terminals Q or $\overline{Q}$ is high, transistor T343 or T353 associated therewith turns off. The corresponding capacitor C345 or C355 is charged via resistor R344 or R354. As a result, after a predetermined time which is a function of the sizing of resistor R344 (or R354) and of capacitor C345 (or C355), threshold THR of circuit 341 (or 351) becomes approximately equal to voltage Vcc (neglecting the voltage drop in resistor R344 or R354). Since triggering input TRIG is then high, output OUT of circuit 341 (or 351) is likely to switch if threshold THR switches high before terminal Q (or $\overline{Q}$) switches back low. In the opposite case, the output of circuit 341 (or 351) will remain low.

It can thus be seen that when one of the outputs of flip-flop 17 remains in a stable active state, a switching of one input of logic gate 36 is caused to trigger a control pulse of signal DEM.

An advantage is that the present invention is particularly well adapted to a high-frequency operation of the switched-mode power supply. In particular, conversely to a digital circuit, no calculation or processing time is required to implement the present invention.

Another advantage of the present invention is that this particularly economical solution enables providing one circuit per panel in the case of a multiple-panel system. Problems of lighting inhomogeneity (for example, upon occurrence of shadow at the scale of a panel or of a cell) are then solved at lesser cost.

Figure 7:
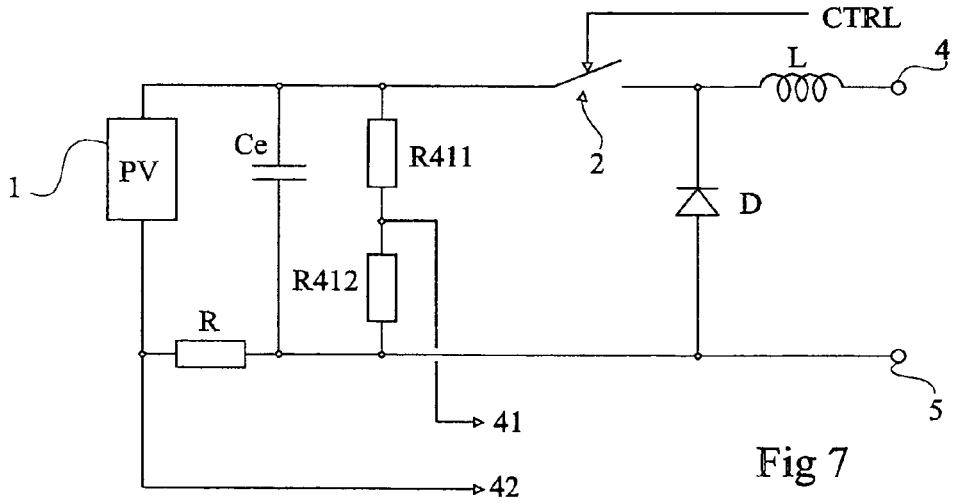
FIG. 7 shows another example of a converter controllable by a circuit according to the present invention.

FIG. 7 shows another embodiment of the present invention to illustrate an assembly on a step-down D.C./D.C. converter. A photovoltaic panel 1 having its two terminals respectively connected to a first terminal of power switch 2 and, by a resistor R of very small value, to ground 5, is considered. The other terminal of switch 2 is connected to a first terminal of an inductive element L having its second terminal forming terminal 4 providing the output voltage to a power storage element, for example, a battery not shown. A free wheel diode D connects the first terminal of inductance L to ground 5. Generally, a capacitor Ce connects the positive output terminal of the photovoltaic panel to ground, to stabilize the voltage across panel 1 and make it insensitive to the switching noise of switch 2. Most often, voltage measurement terminal 41 is connected to the midpoint of a resistive dividing bridge formed of a resistor R411 in series with a resistor R412 between the positive terminal of panel 1 and the ground. The measurement of the current applied on terminal 42 (FIG. 6) is taken on the negative terminal of the photovoltaic panel. Resistor R takes part in the current measurement.

As appears from the foregoing, the present invention applies to any type of converter, be it a step-down, step-up, or step-down/step-up converter. Similarly, the power source may be of any type, provided that information relative to its power can be extracted therefrom.

Of course, the present invention is likely to have various alterations, modifications, and improvements which will readily occur to those skilled in the art. In particular, other analog assemblies than that illustrated in FIG. 6 may be envisaged, provided to respect the described functionalities. For example, delay element 31 may be formed of a capacitor, the capacitance of which varies according to the voltage applied thereacross, of a network of switchable resistors and capacitors, etc. Further, the sizing of the different time constants and resistive and capacitive elements is within the abilities of those skilled in the art based on the functional indications given hereabove and on the application. Moreover, although the foregoing description refers to a measurement of the power as being the product of a voltage by a current, the image of the power may originate from other quantities such as, for example, an impedance measurement, a quantity proportional to the current, assuming that the voltage is constant, a measurement proportional to the voltage, assuming that the current is constant, etc.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for tracking the maximum power point of a variable power source (1) based on a comparison of an image of the power (P) provided by the power source, the circuit comprising:

two elements (14, 31) introducing different propagation delays in a quantity proportional to the power image;

a comparator (16) of the outputs of the delay elements to control a flip-flop (17) providing a two-state signal (Q) for controlling a static power converter;

characterized in that it further comprises means (33) for detecting a transient state from variations of oscillations of a steady state; and means (32) for modifying the delay introduced by the slowest delay element (31).

2. The circuit of claim 1, wherein said means (32) for modifying the delay are formed of a switching element (321) capable of, in transient state, inhibiting the operation of the slower delay element (31).

3. The circuit of claim 1, wherein said detection means (33) compare the duration of an active state on each output signal, (Q, $\overline{Q}$) of the flip-flop (17) with a predetermined threshold (TH1, TH2).

4. The circuit of claim 3, wherein the detection means (33) compare, independently from each other, the forward (Q) and reverse ($\overline{Q}$) outputs of the flip-flop (17) and combine (36) the result of these comparisons to provide a control pulse (DEM) to the means (32) for making the delay variable.

5. The circuit of claim 1, wherein the duration of the transient state is selected according to the desired oscillation amplitude around a nominal power reference value.

6. The circuit of claim 1, wherein the different voltage, current, and time measurement elements are analog.

7. The circuit of claim 1, comprising means for resetting the flip-flop (17) upon occurrence of a transient state.

8. The circuit of claim 1, comprising means for, upon occurrence of a transient state, resetting a ramp generator (13') conditioning the duty cycle of a pulse-width modulation control signal of the power converter.

9. A method for controlling a circuit for tracking the maximum power point of a variable power source (1) of the type applying two delays of different value to an image of the power (P) provided by the power source, consisting of inhibiting or shortening the shortest delay during a transient state.

10. The method of claim 9, consisting of determining the existence of a transient state from a measurement of the frequency of oscillations around a nominal operating point of the maximum power point detector.

* * * * *